United States Patent [19]

Forbes, Jr.

[11] Patent Number: 4,570,787

[45] Date of Patent: Feb. 18, 1986

[54] DISPLAY DEVICE

[75] Inventor: Hampton E. Forbes, Jr., Newark, Del.

[73] Assignee: Westvaco Corporation, New York, N.Y.

[21] Appl. No.: 731,395

[22] Filed: May 7, 1985

[51] Int. Cl.[4] ..... B65D 5/50

[52] U.S. Cl. ..... 206/45.14; 206/45.31; 206/461; 206/486; 206/485

[58] Field of Search ..... 206/45.14, 45.31, 461, 206/486, 488, 490, 485

[56] References Cited

U.S. PATENT DOCUMENTS

| | | | |
|---|---|---|---|
| 1,458,170 | 6/1923 | Dietsche, Jr. . | |
| 1,718,235 | 6/1929 | Hornecker . | |
| 2,983,368 | 5/1961 | Vander Lugt, Jr. | 206/45.14 |
| 3,184,946 | 5/1965 | Berg | 206/45.14 |
| 3,815,735 | 6/1974 | Cucuo | 206/485 |
| 3,918,583 | 11/1975 | Adams | 206/485 |
| 3,990,578 | 11/1976 | Roeser | 206/45.14 |
| 4,023,759 | 5/1977 | Perkins | 206/45.14 |
| 4,191,289 | 3/1980 | Austin | 206/45.14 |
| 4,362,239 | 12/1982 | Roccaforte | 206/45.14 |

*Primary Examiner*—Joseph Man-Fu Moy

[57] ABSTRACT

A display device is disclosed comprising an integral display card and base member which includes a three dimensional article receiving aperture for capturing and retaining in place a displayed article. The base member includes self locking end closure flaps and a pair of front wall flaps which frame the article and releasably secure the article in a locked position. The display card includes additional locking and retaining features in the form of cut outs which are formed in the shape of the displayed article.

4 Claims, 5 Drawing Figures

31
12
30
13
47
26
27
46
45
32
10
11
38
15
39
14
33
18
34
17
16
21
29
28
42
36
35
41
25
20
49
48
19
24
44
37
23
43
22

33
14
18
17
34
25
36
35
24
20
19
23
40
22

DISPLAY DEVICE

BACKGROUND OF INVENTION

Display devices which include an integral display card and product holding means are old and well known in the art. For instance, U.S. Pat. Nos. 1,458,170 and 1,718,235 each show such devices cut from a single blank of paperboard. Meanwhile, U.S. Pat. Nos. 2,983,368 and 3,184,046 each show display devices formed from single blanks of paperboard which include front and back panels adhered together.

However, none of the prior art references teach a display device constructed as disclosed herein with support and display features of great simplicity and effectiveness. The display device disclosed and claimed herein is more readily loaded than the prior art devices and is provided with more reliable and effective product supporting and retaining features than are disclosed in the prior art. Each of the individual features of the present invention cooperate with one another to produce a display device that is superior to the prior art devices.

SUMMARY OF INVENTION

The present invention relates to a display device for articles or the like which has a three dimensional article receiving opening. The display device is formed from a one piece blank of paperboard or the like which is folded and glued to provide a collapsible and erectable article support for use on point-of-purchase display boards.

The design of the display device is such that printability surfaces are provided both front and rear and the displayed product is afforded maximum visibility consistent with a secure enclosure. The base member of the display device provides a three dimensional enclosure for the displayed product while the display card portion includes suitable cut outs for locking the product in place within the three dimensional enclosure.

The strength of the display device disclosed herein is enhanced with a double panel display card and novel locking end flaps on the outer edges of the base member. The display device is readily set up and filled without extra gluing steps or other fasteners and once set up it may stand alone or be displayed on a pin-style display as desired.

The novel elements of the display device include a double panel display card and a base member comprising top, front and bottom walls with a rear wall formed by one of the panels of the display card. This arrangement gives the display device exceptional strength and rigidity using only a minimum amount of paperboard material. At the ends of the base member, self locking flaps are provided which automatically engage with one another when folded to close the ends of the base member and retain the base member in its upright, erected condition. In addition, both the front and rear display panels are provided with cut outs in the same general shape of the displayed products to accomodate the products and to effectively capture and lock them in place.

Accordingly, it is an object of the present invention to provide a collapsible and erectable article support and display device adapted to package articles for point-of-purchase displays.

Another object of the present invention is to provide a collapsible and erectable display device which is formed from a single sheet of paperboard or the like, and which is very compact when collapsed and which may be quickly erected to supportingly receive the article to be displayed.

These and other objects will become apparent from the following detailed description.

DETAILED DESCRIPTION

In the accompanying drawing there is illustrated a one piece display card with an integral base member having a three dimensional article receiving aperture. The display device is formed from a single sheet of paperboard or the like, the blank being generally indicated by the numeral 10 in FIG. 1. The scoring and folding lines on the blank are indicated by dotted lines and the cut out areas are indicated by solid lines.

Figure 1:
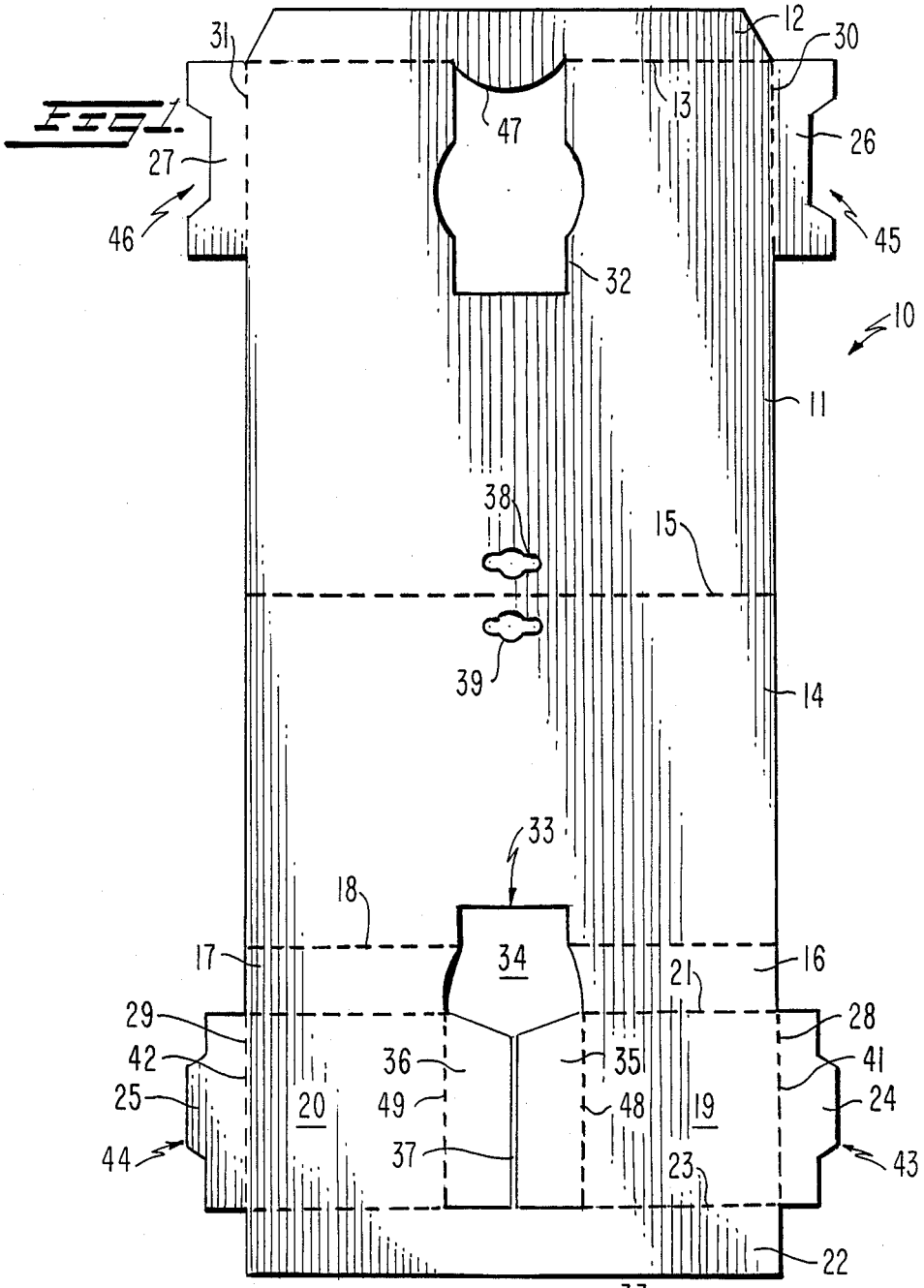
FIG. 1 is a plan view of a blank structure useful for forming the display device of the present invention.

The embodiment illustrated in FIG. 1 comprises a display card rear panel 11 with a glue flap 12 foldably attached to one end along a fold line 13 and a front panel 14 foldably attached to the opposite end along a fold line 15. A pair of base member top wall panels 16 and 17 are foldably attached to the opposite end of front panel 14 along a common score line 18 and a pair of base member front wall panels 19, 20 are foldably attached to the top wal panels 16, 17 along a common fold line 21. The main part of the blank 10 also includes a base member bottom wall panel 22 foldably attached to the front wall panels 19,20 along a common score line 23. Meanwhile a pair of end closure flaps 24,25 are foldably attached to the side edges of front wall panels 19,20 along fold lines 41,42 and a second pair of end closure flaps 26,27 are foldably attached to the side edges of the display card rear panel 11 along fold lines 30,31. The first set of end closure flaps 24,25 each include centrally located elongated extensions 43,44 opposite the fold lines 41,42 respectively and the second set of end closure flaps 26,27 each include centrally located elongated cut away areas 45,46 opposite the fold lines 30,31 respectively. The elongated extensions 43,44 are of about the same size and shape as the elongated cut away areas 45,46.

The blank 10 is also applied with cut out areas for accomodating the displayed article as follows. Display card rear panel 11 includes a cut out 32 that extends from the fold line 13 for a longitudinal distance that is substantially equal to the height of the displayed article. The cut out 32 is preferably located generally at the center of the blank 10 but does not necessarily have to be so located. For instance, where more than one article is to be displayed on a single display device, the cut outs 32 may be symmetrically located and spaced from one another from side-to-side on the rear panel 11. The width of the cut out 32 is less than the width of the displayed article so that it will capture the displayed article and retain it in place. As shown in FIG. 1, a portion 47 of the glue flap 12 extends into the cut out area 32 when the blank is in a flat configuration. When the blank is folded, the portion 47 of glue flap 12 forms a bottom support for the displayed article.

A second cut out area 33 is provided in the front panel 14 of the display card adjacent to the score line 18. Cut out 33 extends from the score line 18 for the distance required to capture the top of the displayed article. Cut out 33 corresponds in width and location on the blank 10 with the cut out 32. The space between the top panels 16 and 17 is designated by the numeral 34 and it is of substantially the same shape and size as the upper part of the displayed article. It should be understood that articles of various cross sectional shape or shapes may be displayed and the various cut outs 32,33 and 34 would be sized and shaped accordingly.

To further support the displayed article, the front wall panels 19 and 20 include a pair of flaps 35,36 respectively which are foldably attached thereto along score lines 48,49. These flaps are of substantially the same size and shape and are separated from one another by a longitudinal slit 37 which is substantially coextensive with the longitudinal center of the cut outs 32,33 and 34. The space between the score lines 48,49 in blank 10 is sufficient to permit the displayed product to be front loaded but not so great that the product might fall out. The flaps 35,36 frame the product and retain it in place.

Figure 2:
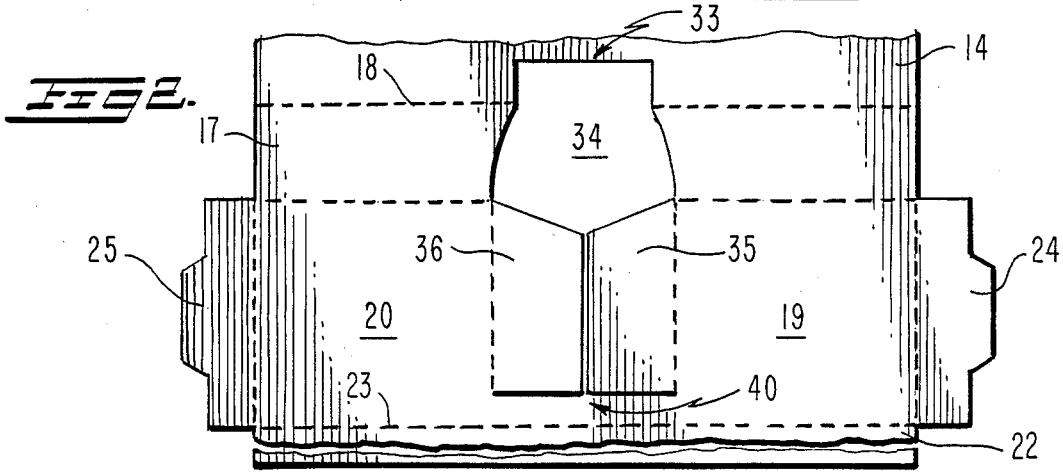
FIG. 2 is a partial plan view of a modified blank structure for forming the display device of the present invention.

The modification of the blank structure shown in FIG. 2 is designed for products which do not extend in front of the three dimensional space provided by the top panels 16,17, front panels 19,20 and bottom wall 22 of the base member. In this instance, the front walls 19,20 are joined together by a connecting portion 40. The result of this modification produces a construction where the flaps 35,36 have a lesser height than in the first embodiment but all other parts of the blank remain the same.

Figure 3:
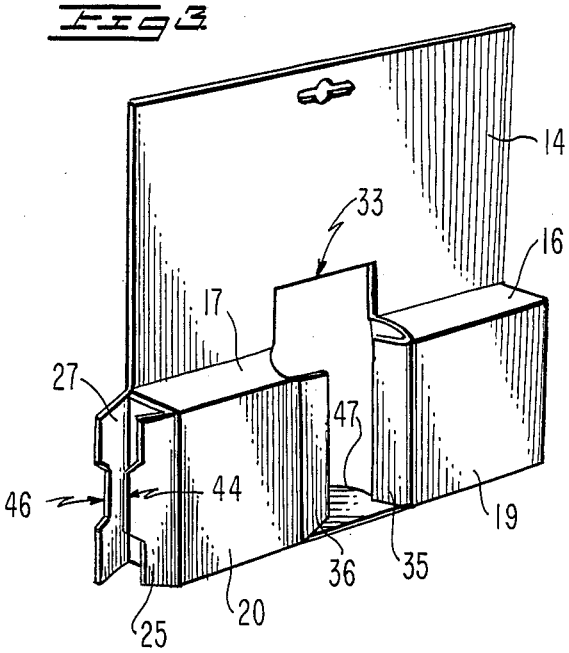
FIG. 3 is a frontal, perspective view showing the folded and glued blank of FIG. 1 in a partially set up condition.
Figure 4:
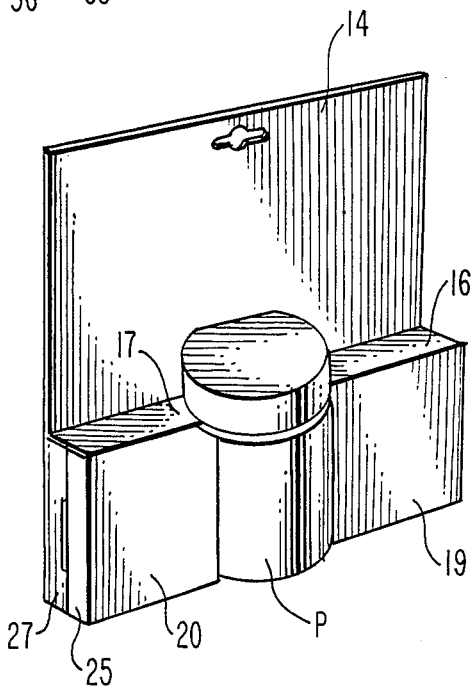
FIG. 4 is a frontal, perspective view showing the fully set up display device loaded with a product; and, FIG. 5 is a rear, perspective view of the display device of FIG. 4.
Figure 5:
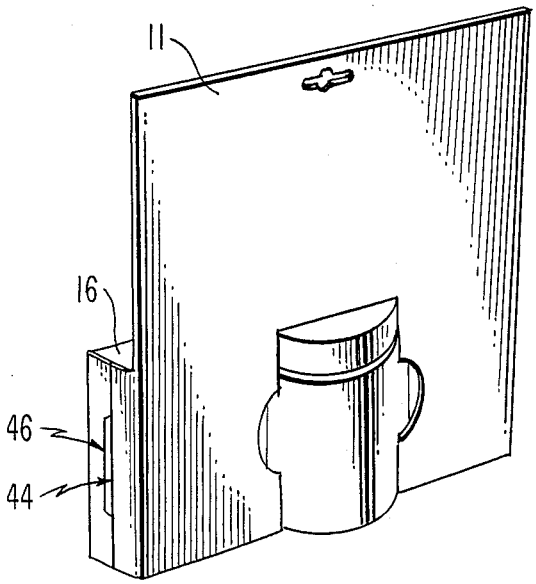

FIG. 3 illustrates the fully formed and set up blank. During the forming process front panel 14 of the display card is folded over about score line 15 and adhered to rear panel 11. At the same time, glue flap 12 is adhered to the bottom wall 22 of the base member. These steps produce a fully formed, collapsed display device. The base member is squared as shown in FIG. 3 and the end flaps 24,26 and 25,27 are locked together to retain the base member in an erected condition. The end flaps become locked together when the extended portions 43 and 44 of flaps 24 and 25 become engaged within the cut away portions 45,46 of flaps 26,27. This is accomplished by simply overpushing the flaps inwardly. The natural tendency for the flaps to return to their normal position causes them to swing back which firmly locks the elements 43 and 44 within slots 45,46 as shown in FIGS. 4 and 5. At the same time, the front panel flaps 35,36 also assist in locking and squaring the base member in its upright position when the product P is loaded into the three dimensional product receiving aperture.

In the embodiment shown in FIGS. 3–5, the product P protrudes from both the front and the rear of the display card and base member. However, it is retained in position by the snug fit between front panels 19,20 the top of cut out 33 and the portion 47 of glue flap 12 at the bottom of the product. When the display device is formed from the blank as modified in FIG. 2, the product fits within the base member and behind the portion 40 of front panels 19 and 20. The front panel flaps 35,36 may be shaped in such instance to closely follow the contours of the packaged product. Meanwhile a portion of the product may still protrude from the rear of the display card particularly as shown in FIG. 5 for the first embodiment.

In both embodiments of the present invention, the display card part is reinforced when the panels 11 and 14 are adhered together. However, to make it convenient to display the products, each of the panels 11 and 14 are provided with openings 38,39 which become aligned when the panels 11 and 14 are adhered together. These openings provide a hole in the card so that, if desired, the display device may be suspended from a pin, nail, hook or the like on a point-of-purchase display.

Having thus described the invention, the appended claims are intended to define what is new and what is desired to be secured by Letters Patent.

What is claimed is:

1. A blank for forming a display card with an integral base member having a three dimensional article receiving aperture comprising:

(a) a rear display card panel;

(b) a glue flap foldably attached to one end of the rear display card along a first fold line;

(c) a front display card panel foldably attached to the other end of the rear display card panel along a second fold line.

(d) a pair of laterally spaced top wall panels foldably attached to the other end of the front panel of said display card about a third fold line;

(e) a pair of laterally spaced front wall panels foldably attached to the free edges of said top wall panels about a fourth fold line;

(f) a bottom wall for said base member foldably attached to the free edges of said front wall panels about a fifth fold line;

(g) a first pair of end closure flaps foldably attached to the side edges of the rear panel of said display card;

(h) a second pair of end closure flaps foldably attached to the outer side edges of the front wall panels;

(i) a first cut out in the rear panel of said display card extending from said first fold line having a longitudinal dimension substantially equal to the height of the displayed article and a width less than the width of said displayed article;

(j) a second cut out in the front panel of said display card adjacent to said third fold line having the same width as said first cut out and a lesser longitudinal dimension than said first cut out; and, (k) a pair of flaps foldably attached to the inner edges of the front panels of said base member, said flaps being of substantially the same size and separated from one another by a longitudinal slit which is coextensive with the longitudinal center of the first cut out.

2. In combination, a display card with an integral base member and an article displayed on said display card and base member, said display card comprising front and rear panels foldably attached to one another at their upper edges and adhered together, said base member comprising top, front, bottom and end walls with a rear wall formed by a portion of the rear panel of said display card, said base member top wall further comprising a pair of forwardly projecting top panels hingedly connected to the bottom edge of the front panel of said display card, said top panels being spaced apart by a distance substantially equal to the width of the displayed article, said base member front wall further comprising a pair of laterally spaced, downwardly projecting front panels hingedly connected to the front edges of said top panels, a bottom wall hingedly connected to the bottom edges of said front panels and projecting forwardly thereof, said glue flap and bottom wall being adhered together, pairs of end closure flaps foldably connected to the outer edges of said front panels and to the outer edges of the rear panel of said display card adjacent to said front panels, said display card and base member together providing a three dimensional article receiving aperture, said aperture including a first cut out in the lower end of the rear panel of said display card having a height equal to the height of the displayed article and a width less than the width of said article, a second cut out in the lower end of the front panel of said display card which coincides with the upper portion of the first cut out, a pair of flaps foldably attached to the inner edges of the laterally spaced front panels of said base member said flaps being of substantially the same size and separated from one another by a longitudinal slit which is coextensive with the longitudinal center of said first cut out, and an article bottom support element of the same general shape and size as the bottom of the article integral with said glue flap which extends into the article receiving aperture of said base member.

3. The combination of claim 2 wherein the end closure flaps on the outer edges of the front panels of said base member and on the outer edges of the rear panel of said display card have self locking shapes comprising tab extensions on the ends of one pair which cooperate with recessed areas on the ends of the other pair.

4. The combination of claim 3 wherein the laterally spaced, downwardly projecting front panels of said base member are joined together at their lower edges by a connecting panel which provides a recessed area for the lower end of said article in the article receiving aperture.

* * * * *